US011363896B2

(12) United States Patent
Hong

(10) Patent No.: US 11,363,896 B2
(45) Date of Patent: Jun. 21, 2022

(54) FRAME FOR FLEXIBLE MATERIAL EXHIBIT

(71) Applicant: Wonkyung Hong, Goyang-si (KR)

(72) Inventor: Wonkyung Hong, Goyang-si (KR)

( * ) Notice: Subject to any disclaimer, the term of this patent is extended or adjusted under 35 U.S.C. 154(b) by 0 days.

(21) Appl. No.: 17/386,911

(22) Filed: Jul. 28, 2021

(65) Prior Publication Data

US 2022/0031094 A1 Feb. 3, 2022

(30) Foreign Application Priority Data

Jul. 30, 2020 (KR) ..... 10-2020-0095317

(51) Int. Cl.
*A47G 1/06* (2006.01)

(52) U.S. Cl.
CPC ..... *A47G 1/065* (2013.01); *A47G 2001/0672* (2013.01); *A47G 2001/0677* (2013.01); *A47G 2001/0688* (2013.01)

(58) Field of Classification Search
CPC .... A47G 2001/0672; A47G 2001/0677; B44D 3/185
See application file for complete search history.

(56) References Cited

U.S. PATENT DOCUMENTS 4,947,561 A * 8/1990 Delacroix ..... B44D 3/185 160/395
7,219,460 B1 * 5/2007 Grayson ..... A47G 1/06 40/711
8,904,688 B1 * 12/2014 Rue ..... B44D 3/185 40/781
2003/0208934 A1 * 11/2003 Ocampo ..... B44D 3/185 38/12
2005/0028417 A1 * 2/2005 Kim ..... A47G 1/14 40/711
2006/0242876 A1 * 11/2006 Davide ..... A47G 1/06 40/779
2007/0193096 A1 * 8/2007 Rice ..... A47G 1/142 40/737
2008/0204474 A1 * 8/2008 Franco ..... A47G 1/065 345/634
2014/0237874 A1 * 8/2014 Tanaka ..... A47G 1/06 40/760

(Continued)

FOREIGN PATENT DOCUMENTS

KR 20-0464550 Y1 1/2013

*Primary Examiner* — Gary C Hoge
(74) *Attorney, Agent, or Firm* — Sughrue Mion, PLLC

(57) ABSTRACT

Disclosed is a frame. The frame includes a framework formed to have a polygonal structure in a plane to surround an outer periphery of a fabric exhibit and including a fastening structure fastened to a rear support portion on a rear surface thereof, the rear support portion fastened to the rear surface of the framework to form a space configured to fix the fabric exhibit between the framework and the rear support portion and having a polygonal panel-shaped structure corresponding to the framework in a plane, a first fixing portion mounted, with a structure corresponding to an edge shape of the fabric exhibit, on a top surface of the rear support portion, and a second fixing portion attached to the first fixing portion by a magnetic force while the fabric exhibit is mounted above the first fixing portion and then a top surface of the fabric exhibit is interposed therebetween.

5 Claims, 8 Drawing Sheets

(56) References Cited

U.S. PATENT DOCUMENTS

2015/0272350 A1* 10/2015 Frankenstein ..... A47G 1/06
40/745
2016/0360903 A1* 12/2016 Knowlden ..... G09F 15/0012

* cited by examiner

FRAME FOR FLEXIBLE MATERIAL EXHIBIT

CROSS-REFERENCE TO RELATED APPLICATION

This application claims priority to and the benefit of Korean Patent Application No. 10-2020-0095317, filed on Jul. 30, 2020, the disclosure of which is incorporated herein by reference in its entirety.

BACKGROUND

1. Field of the Invention

The present invention relates to a frame, and more particularly, to a frame including a structure configured to display a flexible material.

2. Discussion of Related Art

Frames are configured to display or accommodate calligraphic works, photos, or the like and each includes a quadrangular framework, a transparent front panel (glass, transparent acrylic panel, or the like), a rear panel, and the like.

Generally, objects displayed in frames include paintings, photos, and the like. However, the number of cases in which a fabric exhibit, such as a scarf, is fixed in a frame to be displayed has increased.

In a general frame structure as shown in FIG. 1, when a fabric exhibit is inserted between transparent acrylic panels to be displayed, it is difficult to fix the fabric exhibit between acrylic panels without wrinkles.

When the fabric exhibit is attached to an additional intermediate panel using an adhesive to prevent the exhibit from being wrinkled, it is impossible to reuse the fabric exhibit.

Also, since it is difficult to install a fabric exhibit in a frame and to replace the exhibit, technical assistance is necessary.

Accordingly, it is necessary to solve the problems according to the above related art.

RELATED ART DOCUMENT

Patent Document

Korean Utility Model Registration Publication No. 20-0464550 (registered on Dec. 31, 2012)

SUMMARY OF THE INVENTION

The present invention is directed to providing a frame including a structure capable of easily mounting and replacing a flexible exhibit such as a fabric exhibit without damage.

According to an aspect of the present invention, there is provided a frame including a framework formed to have a polygonal structure in a plane to surround an outer periphery of a fabric exhibit and including a fastening structure fastened to a rear support portion on a rear surface thereof, the rear support portion fastened to the rear surface of the framework to form a space configured to fix the fabric exhibit between the framework and the rear support portion and having a polygonal panel-shaped structure corresponding to the framework in a plane, a first fixing portion mounted, with a structure corresponding to an edge shape of the fabric exhibit, on a top surface of the rear support portion, and a second fixing portion attached to the first fixing portion by a magnetic force while the fabric exhibit is mounted above the first fixing portion and then a top surface of the fabric exhibit is interposed therebetween.

The framework may include an upper protruding portion having a structure surrounding the outer periphery of the fabric exhibit, protruding upward to a certain height, and including a variety of shapes of decorative structures, a lower protruding portion having a structure extending downward, by a certain length, from the upper protruding portion and surrounding an outer circumferential surface of the rear support portion, and a fastening structure formed on an inner circumferential surface of the lower protruding portion or mounted on a bottom end surface of the lower protruding portion and fastened to the rear support portion and then fixing the rear support portion.

In this case, the fastening structure may include a fastening surface at which an outer circumferential surface of the rear support portion may slide and be fastened to an inner circumferential surface of the lower protruding portion and a fastening protrusion mounted with a structure protruding to a certain length from a bottom end surface of the lower protruding portion and bent to surround an edge of the rear support portion so as to fix the rear support portion.

The rear support portion may include a spacer formed on the top surface of the rear support portion to protrude upward to a certain height along an edge thereof and configured to space the framework and the rear support portion apart from each other by a certain distance.

The spacer may be formed to protrude to a height as high as a sum of the heights of the first fixing portion and the second fixing portion.

The frame may further include a transparent protection portion interposed between the framework and the second fixing portion, formed of a transparent material, and having a panel-shaped structure protecting the fabric exhibit from the outside.

The frame may further include a mat board interposed between the framework and the second fixing portion and having a structure configured to surround the outer periphery of the fabric exhibit and expose a central portion of the fabric exhibit while shielding the second fixing portion from the outside.

The frame may further include an exhibit wrinkle elimination portion mounted above the rear support portion, disposed between the spacer and the first fixing portion, and configured to pull and fix an edge portion of the fabric exhibit.

The exhibit wrinkle elimination portion may include a rotation mounting portion disposed between the spacer and the first fixing portion, on which a fixing roller is rotatably mounted, and including an exhibit inlet formed along a surface of the fixing roller, the fixing roller mounted on the rotation mounting portion to be rotatable in one direction and configured to catch, transfer, and fix an edge portion of the fabric exhibit inserted through the exhibit inlet along an outer circumferential surface in one direction, and a guide roller mounted to be adjacent to the exhibit inlet and configured to come into contact with a surface of the fabric exhibit entering the exhibit inlet and rotate according to movement of the fabric exhibit.

In this case, the fixing roller may be rotated in one direction by manipulation of a user and released from a fixed state so as to release and separate the edge portion of the fabric exhibit.

A plurality of antislip protrusions having a structure extending by a certain length in a direction perpendicular to a rotation direction may be formed on an outer circumferential surface of the fixing roller.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present invention will be described in detail with reference to the attached drawings. Before this, it is to be noted that the terms or words used in the specification and the claims should not be limited to general or lexical meanings and should be construed as meanings and concepts coinciding with the technical concept of the present invention.

Throughout the specification, when it is stated that a member is located "on" another member, not only the member comes into contact with the other member but also still another member is present therebetween. Throughout the specification, when it is stated that a portion "includes" a component, unless specifically defined otherwise, it means that the portion may not exclude another component but may further include another component.

Figure 1:
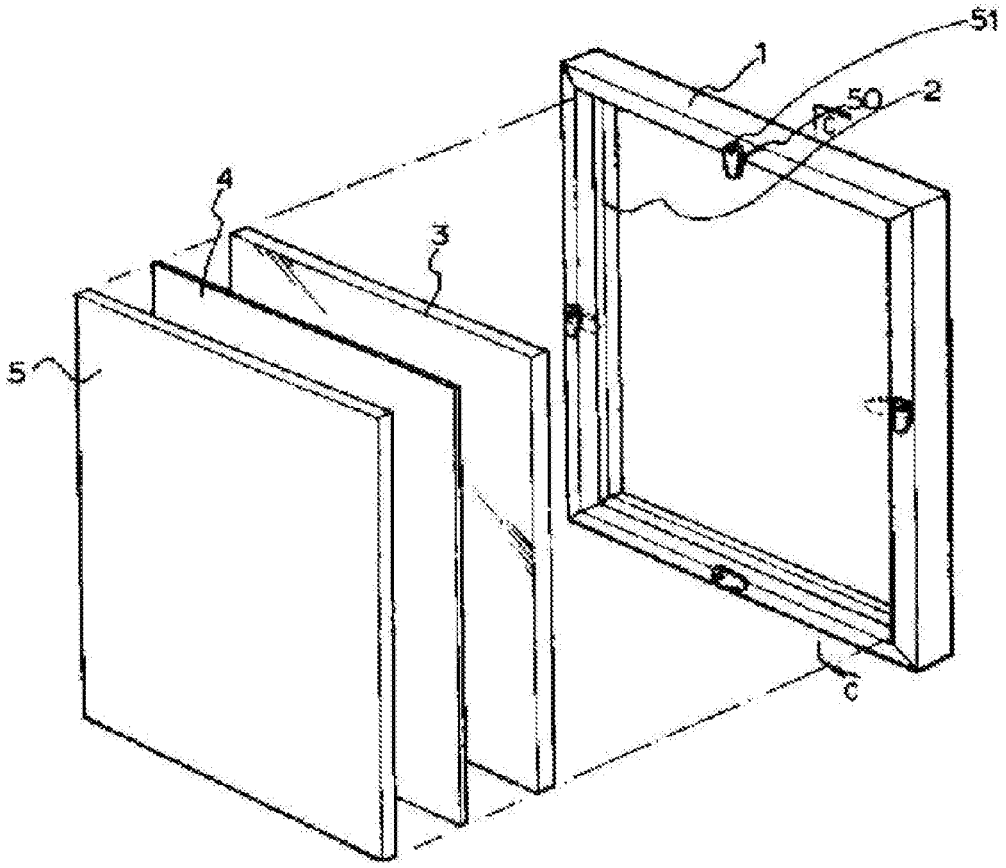
FIG. 1 is a perspective view illustrating a frame according to the related art.
Figure 2:
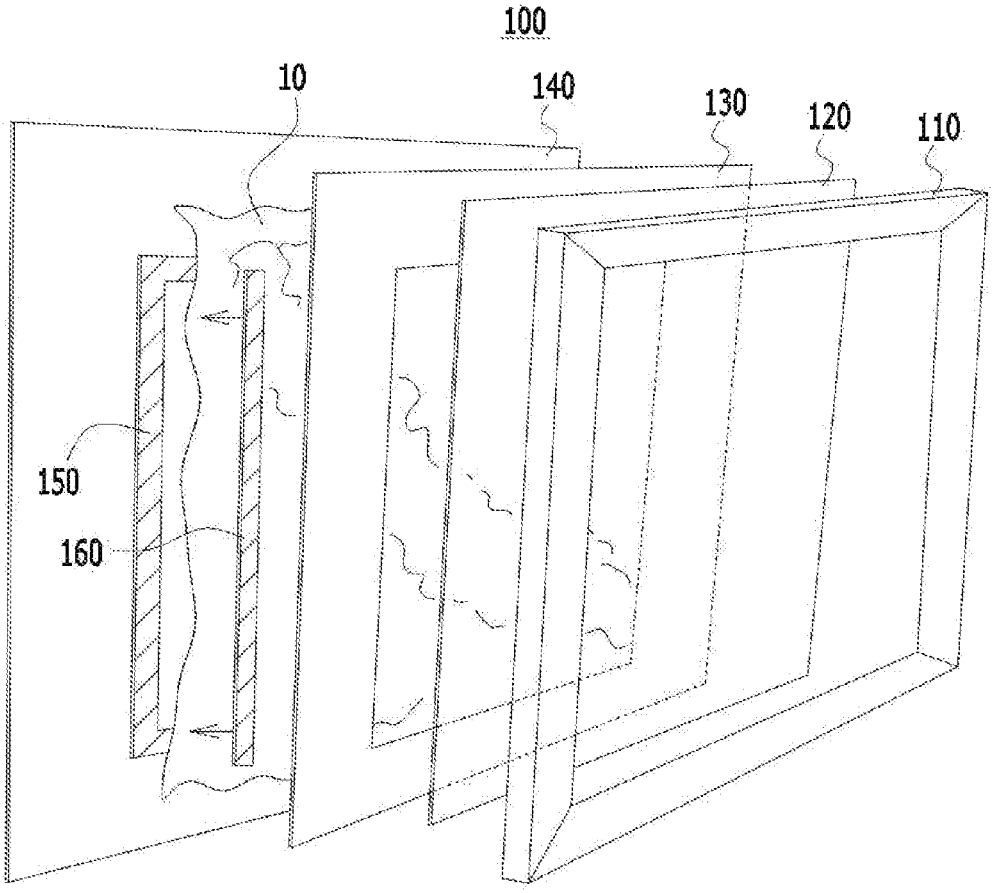
FIG. 2 is an exploded perspective view of a frame according to one embodiment of the present invention.
Figure 3:
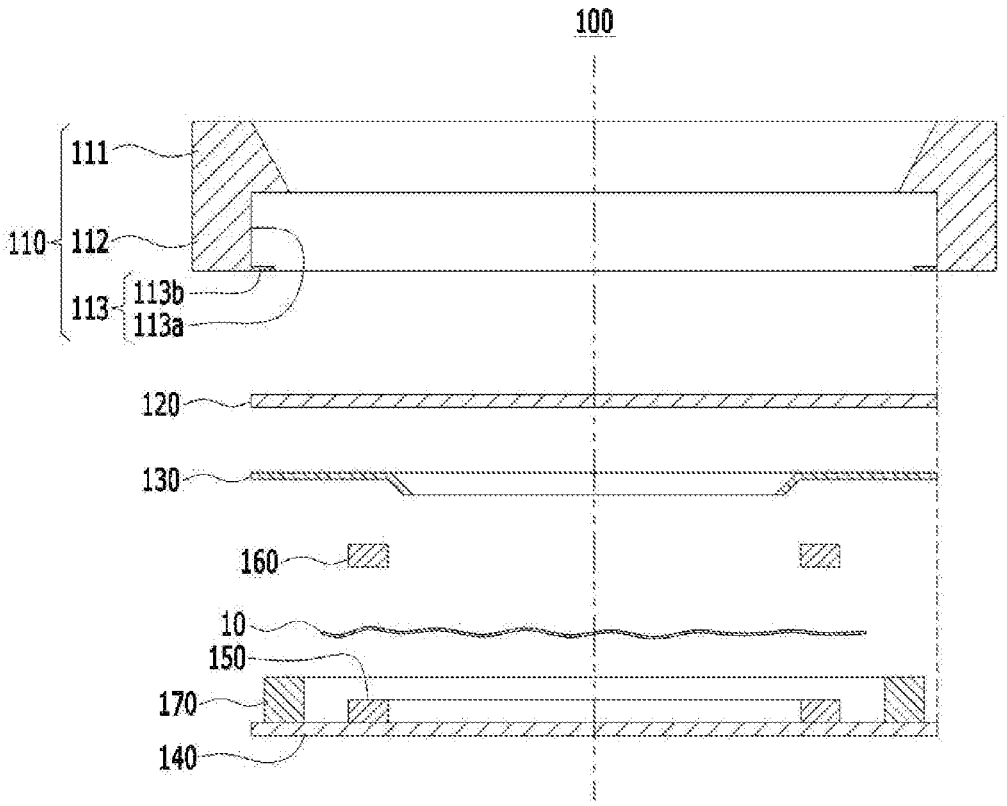
FIG. 3 is an exploded, disassembled cross-sectional view of the frame shown in FIG. 2.

FIG. 2 is an exploded perspective view of a frame according to one embodiment of the present invention, and FIG. 3 is an exploded, disassembled cross-sectional view of the frame shown in FIG. 2.

Referring to these drawings, according to the present invention, a frame 100 including a structure configured to easily mount and replace a flexible exhibit such as a fabric exhibit without damage thereto by including a framework 110 having a particular structure, a rear support portion 140, a first fixing portion 150, and a second fixing portion 160 may be provided.

Hereinafter, the respective components included in the frame 100 according to the embodiment will be described in detail with reference to the drawings.

The framework 110 is a component formed to have a polygonal structure in a plane to surround an outer periphery of a fabric exhibit and has a structure in which a fastening structure fastened to the rear support portion 140 is formed on a rear surface.

As shown in FIG. 2, the framework 110 according to the embodiment may be a component including an upper protruding portion 111 having a particular structure, a lower protruding portion 112, and a fastening structure 113.

In detail, the upper protruding portion 111 has a structure configured to surround the outer periphery of the fabric exhibit and a structure which protrudes to a certain height and includes a variety of shapes of decorative structures. In detail, an inclined plane structure inclined toward a center may be formed. Also, a rabbet structure protruding toward the center so as to place a transparent protection portion thereon may be formed. Here, a frame shape may not necessarily be an inwardly inclined structure and may be an L-shape. That is, the frame shape is changeable to an appropriate shape according to a designer's intention and a user's intention.

The lower protruding portion 112 may have a structure which extends downward from the upper protruding portion 111 by a certain length and surrounds an outer circumferential surface of the rear support portion 140.

Also, the fastening structure 113 may be formed on an inner circumferential surface of the lower protruding portion 112 or mounted on a bottom end surface of the lower protruding portion 112 so as to be fastened to the rear surface portion 140 and then fix the rear support portion 140.

Here, the fastening structure 113 according to the embodiment may be a component including a fastening surface 113*a* and a fastening protrusion 113*b*.

Figure 4:
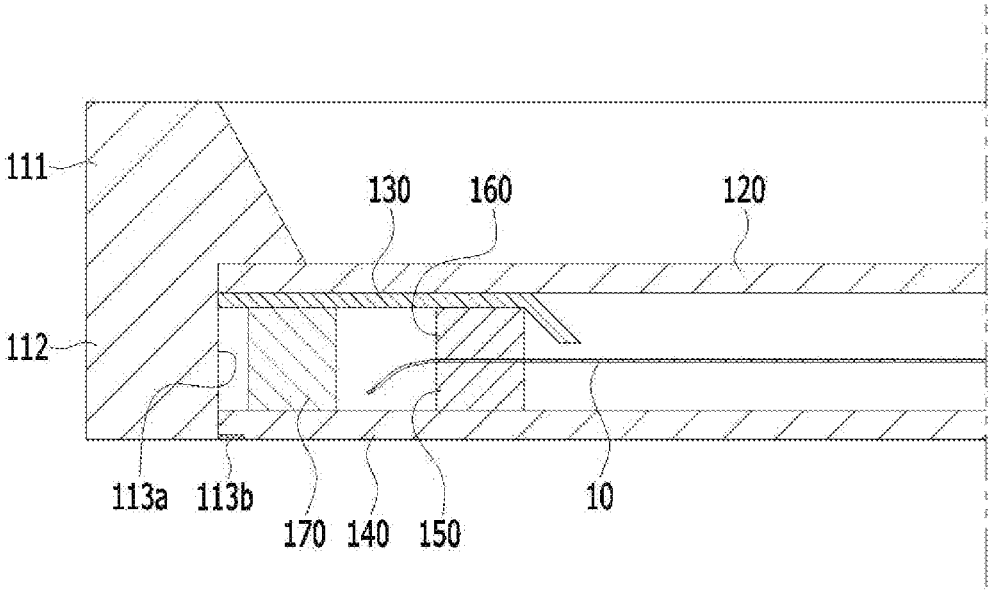
FIG. 4 is a partial enlarged cross-sectional view illustrating a state in which a fabric exhibit is fixed to the frame according to one embodiment of the present invention.

At the fastening surface 113*a*, as shown in FIGS. 3 and 4, an outer circumferential surface of the rear support portion 140 may slide on and be fastened to the inner circumferential surface of the lower protruding portion 112.

As shown in FIGS. 3 and 4, the fastening protrusion 113*b* may be mounted with a structure protruding to a certain length from the bottom end surface of the lower protruding portion 112 and bent to surround an edge of the rear support portion 140 so as to fix the rear support portion 140.

The rear support portion 140 is a component fastened to a rear surface of the framework 110 to form a space fixing a fabric exhibit between the framework 110 and the rear support portion 140 and may have a polygonal panel-shaped structure corresponding to the framework 110 in a plane.

Preferably, as shown in FIGS. 3 and 4, a spacer 170 may be mounted on a top surface of the rear support portion 140. In detail, the spacer 170 may protrude upward to a certain length along an edge of the top surface of the rear support portion 140 and may space the framework 110 apart from the rear support portion 140 by a certain length. Here, as shown in FIG. 4, a protruding height of the spacer 170 may be formed as high as a sum of the heights of the first fixing portion 150 and the second fixing portion 160.

Figure 5:
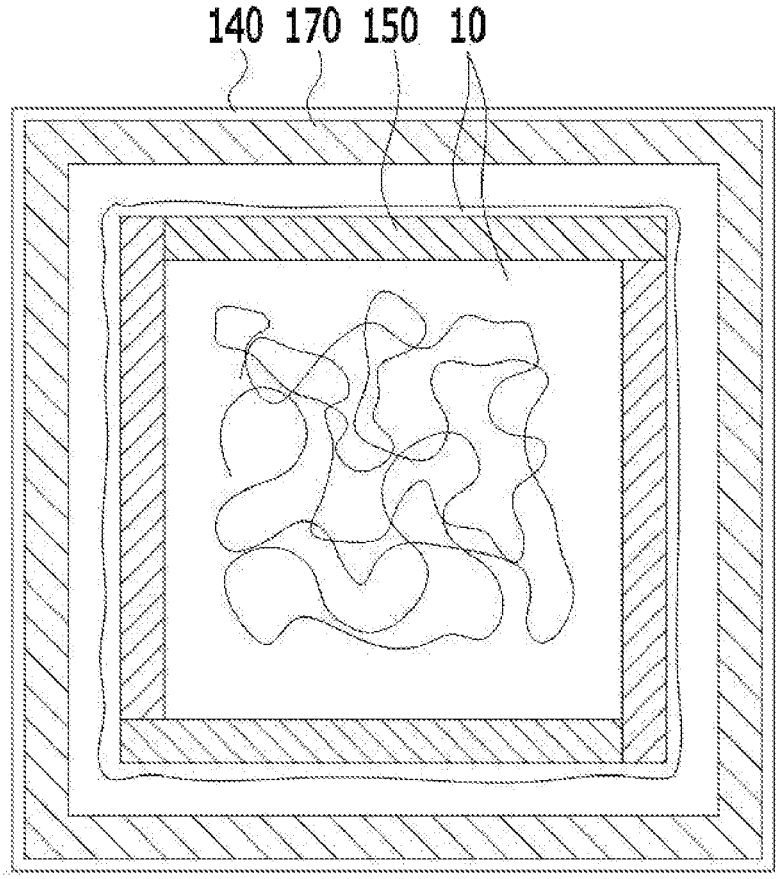
FIG. 5 is a plan view illustrating a state in which the fabric exhibit is placed on a first fixing portion mounted above a rear support portion and then fixed using a second fixing portion according to one embodiment of the present invention.
Figure 6:
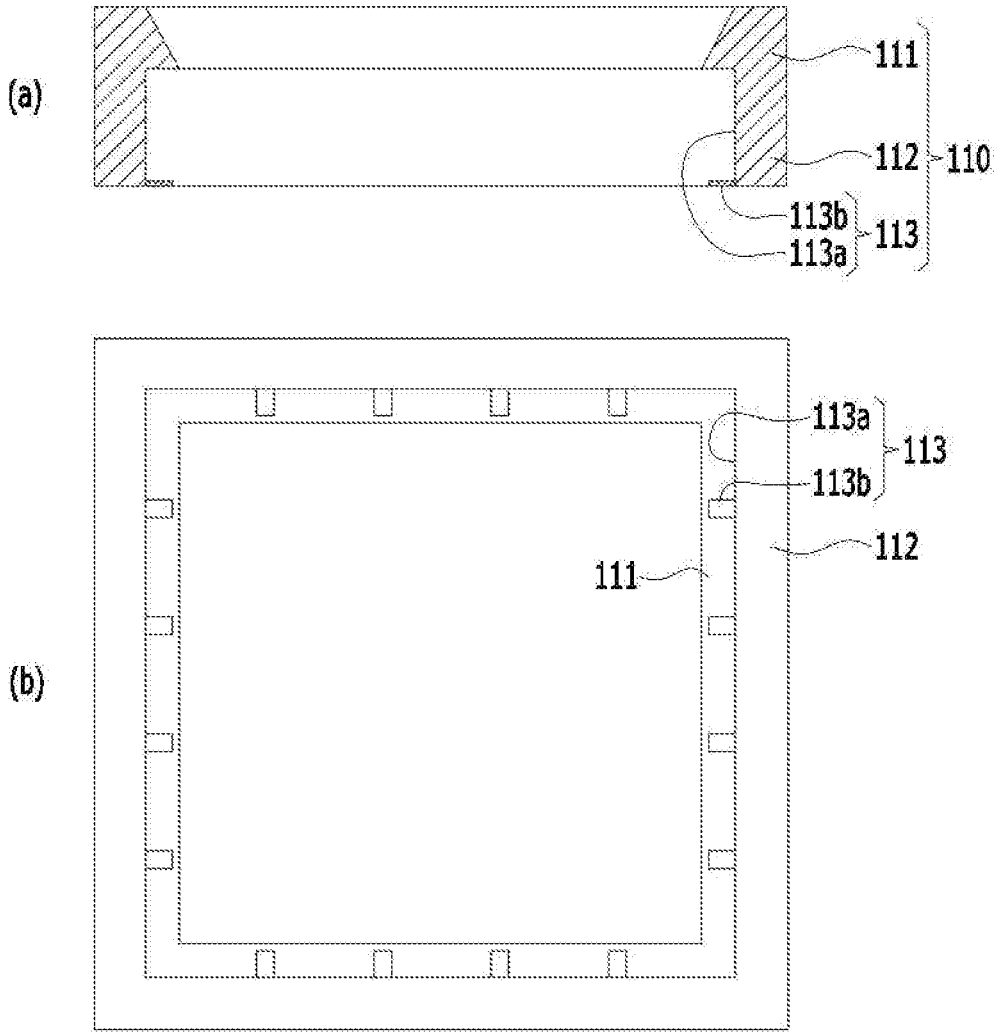
FIG. 6 shows a longitudinal cross-sectional view ((a) of FIG. 6) and a rear view ((b) of FIG. 6) of the frame according to one embodiment of the present invention.

FIG. 5 is a plan view illustrating a state in which the fabric exhibit is placed on a first fixing portion mounted above a rear support portion and then fixed using a second fixing portion according to one embodiment of the present invention, and FIG. 6 shows a longitudinal cross-sectional view ((a) of FIG. 6) and a rear view ((b) of FIG. 6) of the frame according to one embodiment of the present invention.

Referring to these drawings, the first fixing portion 150 according to the embodiment may be mounted, with a structure corresponding to an edge shape of the fabric exhibit, on the top surface of the rear support portion 140.

Also, the second fixing portion 160 according to the embodiment may be attached to the first fixing portion 150 by a magnetic force while the fabric exhibit is mounted above the first fixing portion 150 and then a top surface of the fabric exhibit is interposed therebetween.

As shown in FIG. 4, since the edge of the fabric exhibit is held and fixed using the first fixing portion 150 and the second fixing portion 160 according to the embodiment, the fabric exhibit may be easily fixed to a desired location and easily separated by detaching the second fixing portion 160. Also, the first fixing portion 150 and the second fixing portion 160 are attached to each other by a magnetic force so as to prevent the fabric exhibit interposed and fixed between the first fixing portion 150 and the second fixing portion 160 from being damaged.

In some cases, parts of the first fixing portion 150 and the second fixing portion 160 which come into contact with each other may be formed to have corresponding uneven structures which are matched and fastened to each other so as to more stably fix the fabric exhibit.

In some cases, as shown in FIGS. 2 to 4, the frame 100 according to the embodiment may further include a transparent protection portion 120 having a particular structure and a mat board 130.

In detail, the transparent protection portion 120 according to the embodiment is a component interposed between the framework 110 and the second fixing portion 160, may be formed of a transparent material and have a panel-shaped structure configured to protect the fabric exhibit from the outside. Here, as the transparent protection portion 120, a glass material or a transparent acrylic material may be selected.

Also, the mat board 130 according to the embodiment is a component interposed between the framework 110 and the second fixing portion 160 and has a structure surrounding an outer periphery of the fabric exhibit and may expose a central portion of the fabric exhibit while shielding the second fixing portion from the outside.

Figure 7:
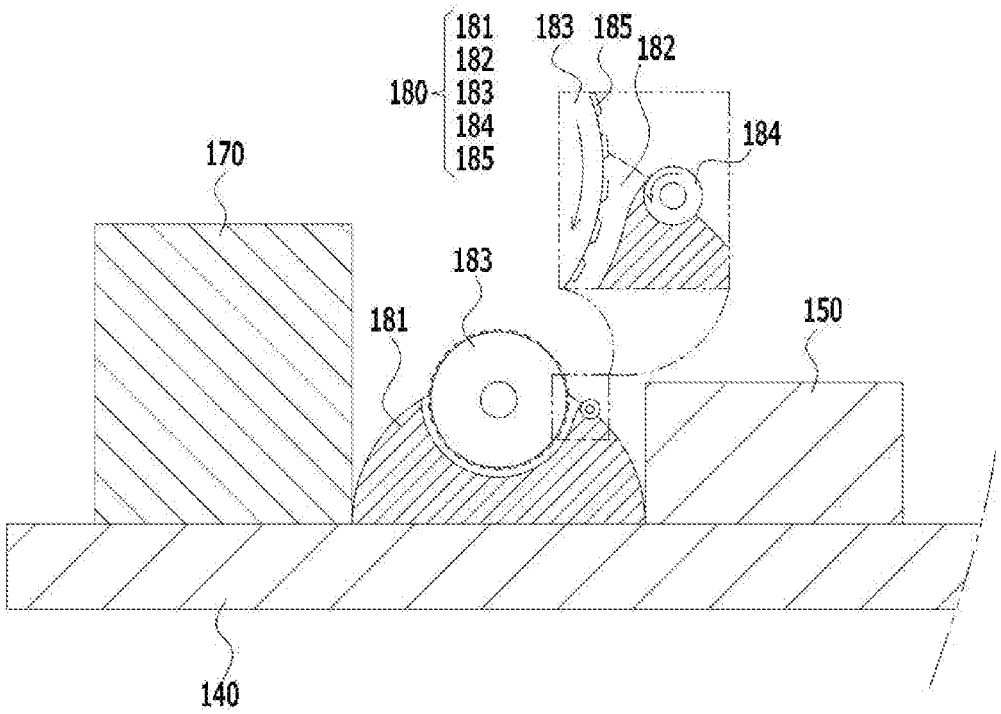
FIG. 7 is a partial enlarged cross-sectional view illustrating an exhibit wrinkle elimination portion of a frame according to another embodiment of the present invention.
Figure 8:
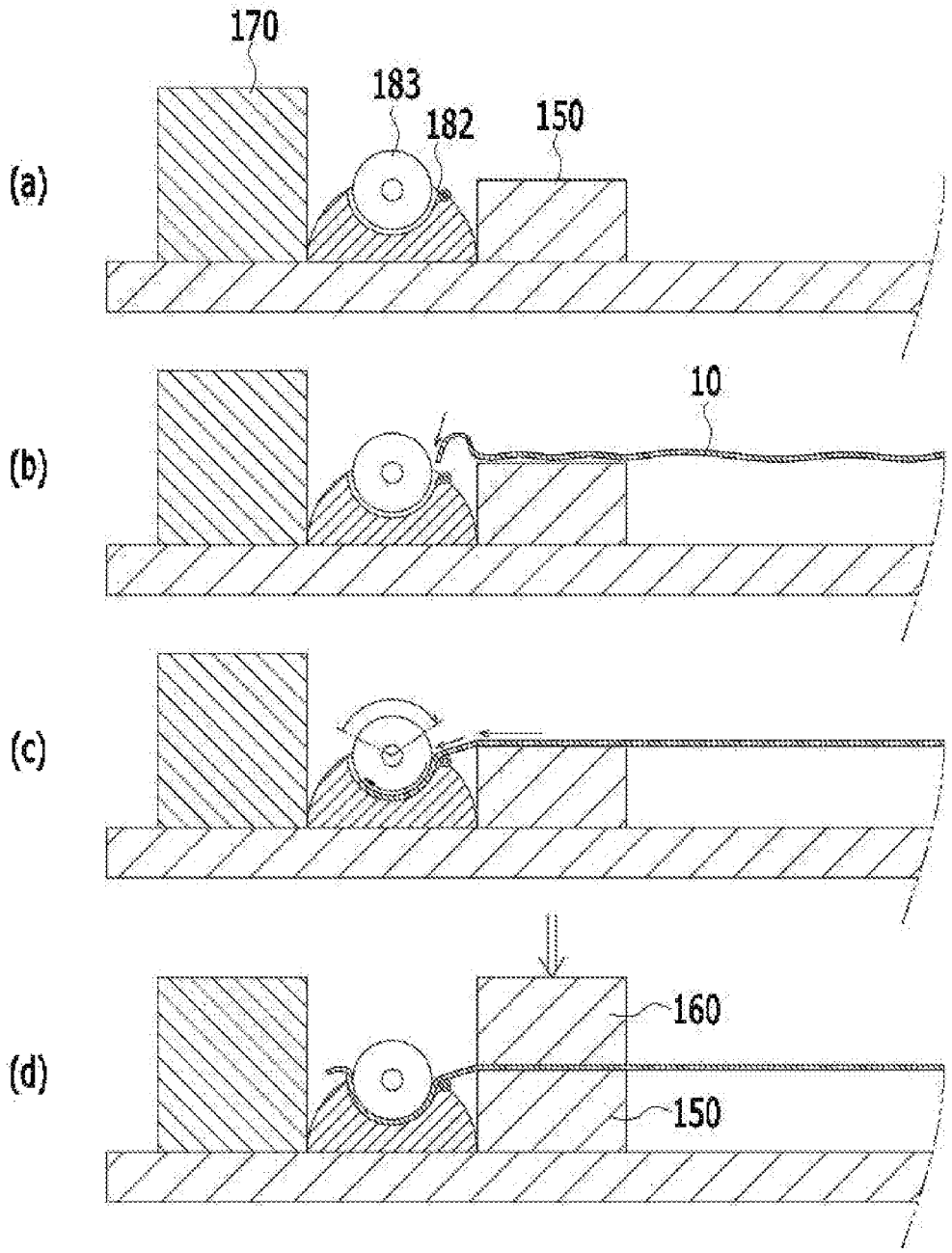
FIG. 8 shows partial enlarged cross-sectional views illustrating a state in which wrinkles of a fabric exhibit are eliminated and the fabric exhibit is fixed using the exhibit wrinkle elimination portion of FIG. 7.

FIG. 7 is a partial enlarged cross-sectional view illustrating an exhibit wrinkle elimination portion of a frame according to another embodiment of the present invention, and FIG. 8 shows partial enlarged cross-sectional views illustrating a state in which wrinkles of a fabric exhibit are eliminated and the fabric exhibit is fixed using the exhibit wrinkle elimination portion of FIG. 7.

Referring to these drawings, the exhibit wrinkle elimination portion 180 according to the embodiment is a component mounted above the rear support portion 140, is disposed between the spacer 170 and the first fixing portion 150 and may hold and fix the edge portion of the fabric exhibit.

In detail, the exhibit wrinkle elimination portion 180 according to the embodiment may include a rotation mounting portion 181 having a particular structure, a fixing roller 183, and a guide roller 184.

The rotation mounting portion 181 is a component disposed between the spacer 170 and the first fixing portion 150 and a component on which the fixing roller 183 is rotatably mounted and which has a structure in which an exhibit inlet 182 formed along a surface of the fixing roller 183 is formed.

The fixing roller 183 is a component mounted on the rotation mounting portion 181 to be rotatable in one direction and may catch, transfer, and fix the edge portion of the fabric exhibit inserted through the exhibit inlet 182 in one direction along an outer circumferential surface. Here, the fixing roller 183 may be released from a fixed state after rotating in one direction by manipulation of a user and release and separate the edge portion of the fabric exhibit therefrom.

Preferably, as shown in FIG. 7, a plurality of antislip protrusions 185 having a structure extending by a certain length in a direction perpendicular to a rotation direction may be formed on the outer circumferential surface of the fixing roller 183.

Also, the guide roller 184 is a component mounted while adjacent to the exhibit inlet 182 and may come into contact with the surface of the fabric exhibit entering the exhibit inlet 182 and rotate according to movement of the fabric exhibit.

In the frame 100 according to the embodiment which includes the above components, as shown in FIG. 8, one end of the edge of the fabric exhibit 10 is inserted into the exhibit inlet 182 of the exhibit wrinkle elimination portion 180 (refer to (b) of FIG. 8) and then the fixing roller 183 is rotated clockwise so as to allow the antislip protrusion 185 to catch and pull one end of the edge of the fabric exhibit into the exhibit inlet 182. Here, the one end of the edge of the fabric exhibit 10 is inserted along the exhibit inlet 182 formed along the outer circumferential surface of the fixing roller 183 (refer to (c) of FIG. 8). Subsequently, the fixing roller 183 is fixed so as not to rotate counterclockwise to maintain a taut state and then the second fixing portion 160 is placed on and attached to a location corresponding to the first fixing portion 150 so as to fix the edge of the fabric exhibit 10 (refer to (d) of FIG. 8). Subsequently, the mat board 130, the transparent protection portion 120, and the framework 110 may be assembled so as to easily complete fixing of the fabric exhibit 10.

As described above, according to the present invention, a frame including a structure configured to easily mount and replace a flexible exhibit such as a fabric exhibit without damage thereto by including the framework 110 having a particular structure, the rear support portion 140, the first fixing portion 150, and the second fixing portion 160 may be provided.

Also, according to the present invention, a frame including a structure configured to fix a flexible exhibit such as a fabric exhibit to easily maintain a taut state by including the exhibit wrinkle elimination portion 180 including the rotation mounting portion 181 having a particular structure, the fixing roller 183, and the guide roller 184 may be provided.

As described above, according to the present invention, a frame including a structure configured to easily mount and replace a flexible exhibit such as a fabric exhibit without damage thereto by including a framework having a particular structure, a rear support portion, a first fixing portion, and a second fixing portion can be provided.

Also, according to the present invention, a frame including a structure configured to fix a flexible exhibit such as a fabric exhibit to easily maintain a taut state by including an exhibit wrinkle elimination portion including a rotation mounting portion having a particular structure, a fixing roller, and a guide roller can be provided.

Only a particular embodiment of the present invention has been described above in the detailed description of the present invention. However, the present invention should be construed as being not limited to the particular embodiment described above in the detailed description and should be construed as including all modifications, equivalents, and substitutes within the range of the present invention defined by the attached claims.

That is, the present invention is not limited to the particular embodiment and description and a variety of modifications may be made by one of ordinary skill in the art without departing from the concept of the present invention and included within the scope of protection of the present invention.

What is claimed is:

1. A frame comprising:

a framework (110) formed to have a polygonal structure in a plane to surround an outer periphery of a fabric exhibit and comprising a fastening structure fastened to a rear support portion (140) on a rear surface thereof;

the rear support portion (140) fastened to the rear surface of the framework (110) to form a space configured to fix the fabric exhibit between the framework (110) and the rear support portion (140) and having a polygonal panel-shaped structure corresponding to the framework (110) in a plane;

a first fixing portion (150) mounted, with a structure corresponding to an edge shape of the fabric exhibit, on a top surface of the rear support portion (140); and a second fixing portion (160) attached to the first fixing portion (150) by a magnetic force while the fabric exhibit is mounted above the first fixing portion (150) and then a top surface of the fabric exhibit is interposed therebetween.

2. The frame of claim 1, wherein the framework (110) comprises:

an upper protruding portion (111) having a structure surrounding the outer periphery of the fabric exhibit, protruding upward to a certain height, and including a variety of shapes of decorative structures;

a lower protruding portion (112) having a structure extending downward, by a certain length, from the upper protruding portion (111) and surrounding an outer circumferential surface of the rear support portion (140); and a fastening structure (113) formed on an inner circumferential surface of the lower protruding portion (112) or mounted on a bottom end surface of the lower protruding portion (112) and fastened to the rear support portion (140) and then fixing the rear support portion (140).

3. The frame of claim 1, wherein the rear support portion (140) comprises a spacer (170) formed on the top surface of the rear support portion (140) to protrude upward to a certain height along an edge thereof and configured to space the framework (110) and the rear support portion (140) apart from each other by a certain distance, and wherein the spacer (170) is formed to protrude to a height as high as a sum of the heights of the first fixing portion (150) and the second fixing portion (160).

4. The frame of claim 3, further comprising an exhibit wrinkle elimination portion (180) mounted above the rear support portion (140), disposed between the spacer (170) and the first fixing portion (150), and configured to pull and fix an edge portion of the fabric exhibit.

5. The frame of claim 4, wherein the exhibit wrinkle elimination portion (180) comprises:

a rotation mounting portion (181) disposed between the spacer (170) and the first fixing portion (150), on which a fixing roller (183) is rotatably mounted, and comprising an exhibit inlet (182) formed along a surface of the fixing roller (183);

the fixing roller (183) mounted on the rotation mounting portion (181) to be rotatable in one direction and configured to catch, transfer, and fix an edge portion of the fabric exhibit inserted through the exhibit inlet (182) along an outer circumferential surface in one direction; and a guide roller (184) mounted to be adjacent to the exhibit inlet (182) and configured to come into contact with a surface of the fabric exhibit entering the exhibit inlet (182) and rotate according to movement of the fabric exhibit.

* * * * *